US005730007A

United States Patent [19]

McIllwain

[11] Patent Number: 5,730,007

[45] Date of Patent: Mar. 24, 1998

[54] PREDILUTION MECHANISM FOR CHEMICAL SOLUTIONS FOR WASHING MACHINES

[76] Inventor: Jim L. McIllwain, 135 Buffalo Creek Dr., Crandall, Tex. 75114

[21] Appl. No.: 542,155

[22] Filed: Oct. 12, 1995

[51] Int. Cl.[6] ..... D06F 39/02

[52] U.S. Cl. ..... 68/17 R; 68/207

[58] Field of Search ..... 68/17 R, 207; 134/99.2

[56] References Cited

U.S. PATENT DOCUMENTS

| | | | |
|---|---|---|---|
| 2,055,254 | 9/1936 | Hanney | 68/17 R X |
| 3,041,834 | 9/1962 | Siegla | 68/17 R X |
| 3,982,666 | 9/1976 | Kleimola et al. | 68/17 R X |
| 4,188,807 | 2/1980 | Graf et al. | 68/17 R |

FOREIGN PATENT DOCUMENTS

| | | | |
|---|---|---|---|
| 0528768 | 2/1993 | European Pat. Off. | 68/17 R |

*Primary Examiner*—Philip R. Coe

*Attorney, Agent, or Firm*—R. Darryl Burke; Worsham, Forsythe & Wooldridge, L.L.P.

[57] ABSTRACT

An apparatus for prediluting chemical solutions before the chemical solutions are injected into a wash tub of a washing machine comprises a wash tub, a chemical solution conduit, at least one dilution conduit, a mixing conduit, and a junction. The wash tub has an interior volume and a first opening in communication with the interior volume. The chemical solution conduit transports the chemical solutions into the wash tub of the washing machine. The chemical solution conduit has a first opening therein to receive the chemical solutions. The dilution conduits transports dilution solutions into the washing machine. The dilution conduits have at least one opening therein to receive the dilution solutions. The mixing conduit has a first end and a second end. The second end is in liquid communication with the opening in the wash tub to transport liquids into the wash tub. The junction is mechanically coupled to the at least one dilution conduit and to the chemical solution conduit, and to the second end of the mixing conduit, so that the at least one dilution conduit and the chemical solution conduit are in liquid communication with the interior volume of the wash tube. The junction combines and mixes the chemical solutions transported by the chemical solution conduit and the dilution materials transported by the at least one dilution conduit, so that the chemical solutions and the dilution materials are mixed together in the mixing conduit before entering the wash tub.

36 Claims, 4 Drawing Sheets

BACK VIEW

FRONT VIEW

BACK VIEW

FRONT VIEW

PREDILUTION MECHANISM FOR CHEMICAL SOLUTIONS FOR WASHING MACHINES

PARTIAL WAIVER OF COPYRIGHT
PURSUANT TO 1077 O.G. 22 (Mar. 20, 1987)

© Copyright, Jim L. McIllwain 1995. All of the material in this patent application is subject to copyright protection under the copyright laws of the United States and of other countries. As of the first effective filing date of the present application, this material is protected as unpublished material.

However, permission to copy this material is hereby granted to the extent that the owner of the copyright rights has no objection to the facsimile reproduction by anyone of the patent document or patent disclosure, as it appears in the United States Patent and Trademark Office patent file or records, but otherwise reserves all copyright rights whatsoever.

FIELD OF THE INVENTION

The present invention relates to predilution systems and methods for washing machines, especially for cleaning fluids and liquids that are used for cleaning purposes.

BACKGROUND

A number of chemical solutions (e.g., chemical solutions such as detergent, soap, and bleach) used in conjunction with washing machines (e.g., industrial) to clean clothing and cloth items of all types. Existing washing machines simply inject the materials into the tub of a washing machine in an undiluted state. It takes several minutes to dilute the chemical solutions as the wash tub fills with water or similar diluting material and everything in the wash tub is mixed together. These chemical solutions are often quite strong and, if these chemical solutions are not diluted, these chemical solutions may damage the actual clothing or cloth items to be washed and, even, the actual washing machine itself. For instance, rubber hoses, rubber products, electrical control circuitry, water seals, bearings, and the rear basket support inside the wash tub are especially vulnerable when the chemical solution comes into contact with these items. This is a major concern for all users of washing machines and these chemicals, especially for large-scale, industrial users of these washing machines, such as hotels, professional dry-cleaning businesses, etc.

SUMMARY

Preferred embodiments of an apparatus for prediluting chemical solutions before the chemical solutions are injected into a wash tub of a washing machine are disclosed herein. The wash tub has an interior volume and a first opening in communication with the interior volume. Cloth items (e.g., linens, shirts, towels, washrags, socks, and pants) are placed in the wash tub. Preferred embodiments comprise a chemical solution conduit, at least one dilution conduit, a mixing conduit, and a junction. The chemical solution conduit transports chemical solutions into the wash tub of the washing machine. The chemical solution conduit has a first opening therein to receive the chemicals. The dilution conduit(s) transport dilution solutions (e.g., water) into the washing machine. The dilution conduit has at least one opening therein to receive the dilution solutions. The mixing conduit has a first end and a second end. The second end is in fluid communication with the opening in the wash tub to transport liquids into the wash tub. A junction is mechanically coupled to the dilution conduit(s) and to the chemical solution conduit, and to the second end of the mixing conduit, so that the at least one dilution conduit and the chemical solutions conduit are in fluid communication with the interior volume of the wash tube. The junction combines the chemical solutions transported by the chemical solution conduit and the dilution materials transported by the dilution conduit(s), so that the chemical solutions and the dilution materials are mixed together in the mixing conduit before entering the wash tub. In addition, a drain outlet is preferably in fluid communication with the opening in the wash tub through a drain outlet control valve via a drain conduit. The drain outlet control is mechanically positioned between the wash tub drain and the drain outlet to control the fluid communication between the opening and the drain outlet. Also, dilution conduit is mechanically coupled to the drain conduit, so that the mixing conduit and the drain conduit are in liquid communication with one another. Note that the mixing conduit has a mixing interior volume that is sufficiently large enough to permit adequate mixing of the chemical solution and the dilution material. Also, the mixing conduit must be long enough to enable the mixing material and the dilution material to be adequately mixed together while being transported to the wash tub. Examples of chemical solutions include sodium hydroxide, nonylphenol elhoxylate, complex phosphonate, sodium polyacrylate, sodium chloride, sodium hyphochlorite, quatemary, ammonium compounds, alkyl phosphates, phosphonic acid, distearyl dimenthyl and ammonium chloride.

Preferred embodiments provide a number of advantages. As discussed above, the preferred embodiments substantially reduce or completely eliminate the damage to the washing machine itself, including the machine structure, linen, rubber hoses, rubber products, electrical circuitry, bearings, rear basket support, etc., and the damage to the clothing items to be cleaned, such as linens, shirts, etc.

Other advantages of the invention and/or inventions described herein will be explained in greater detail below.

BRIEF DESCRIPTION OF THE DRAWINGS

The accompanying drawings are incorporated into and form a part of the specification to illustrate several examples of the present inventions. These drawings together with the description serve to explain the principles of the inventions. The drawings are only for the purpose of illustrating preferred and alternative examples of how the inventions can be made and used and are not to be construed as limiting the inventions to only the illustrated and described examples. Further features and advantages will become apparent from the following and more particular description of the various embodiments of the invention, as illustrated in the accompanying drawings, wherein.

DETAILED DESCRIPTION OF THE PREFERRED EMBODIMENT

Figure 1B:
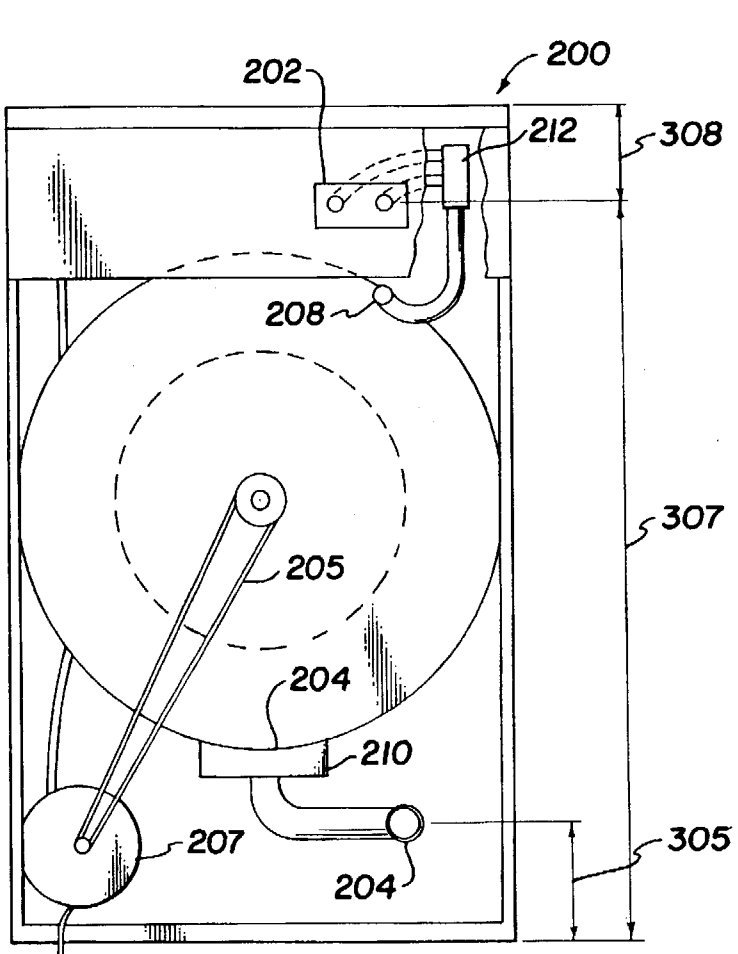
Fig. 1B (PRIOR ART)
FIGS. 1A and 1B are front and back cross-sectional illustrations of existing, prior art embodiments of a washing machine 200 having water inlet valves 202, drain outlet 204, wash tub 206, drain valve 210, and siphon breaker 212.

The present inventions will be described by referring to apparatus and methods showing various examples of how the inventions can be made and used. When possible, like reference characters are used throughout the several views of the drawing to indicate like or corresponding parts.

Figure 1A:
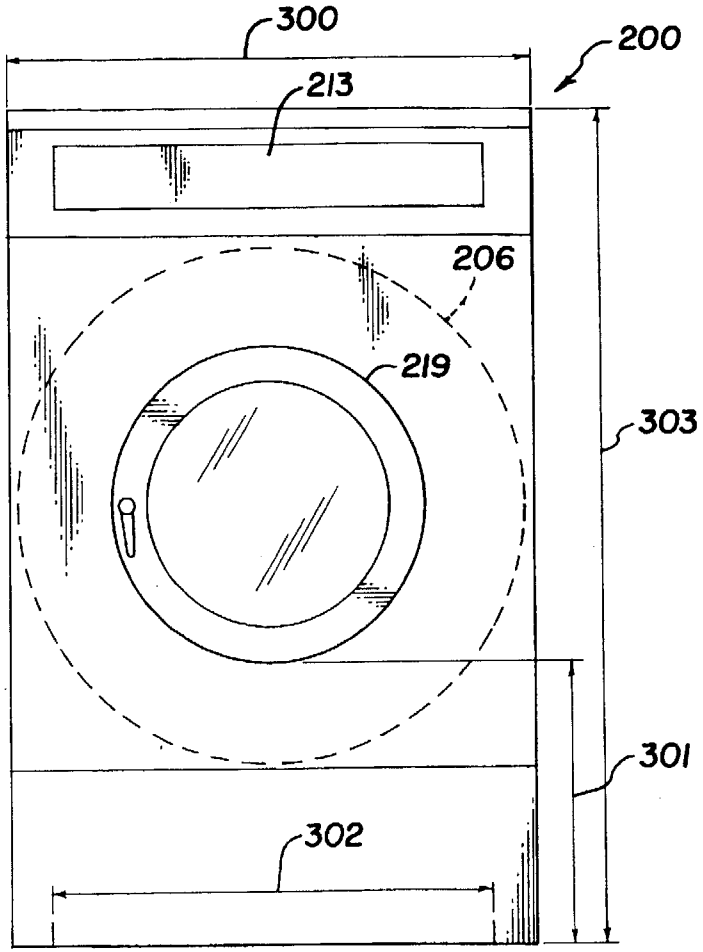
Fig. 1A (PRIOR ART)
Figure 1C:
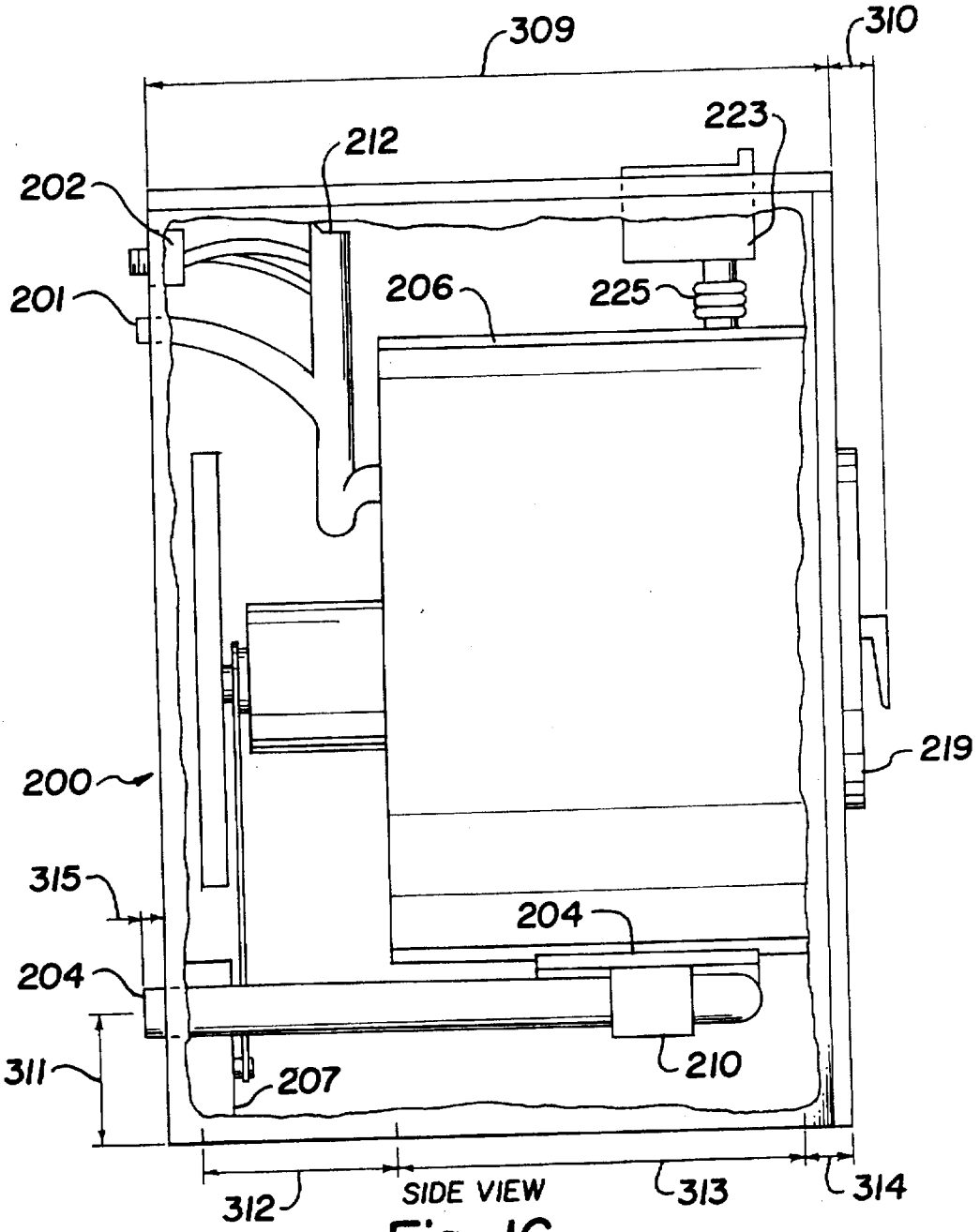
Fig. 1C (PRIOR ART)
FIG. 1C is a cross-sectional view of an existing, prior art embodiment of a washing machine showing the interrelation of water inlet valves 202, drain outline 204, wash tub 206, drain valve 210, and siphon breaker 212.

FIGS. 1A and 1B are front and back perspective illustrations of an existing, prior art embodiment of a washing machine 200 having inlet valves 202, drain outlet 204, electrical motor 207, wash tub 206, drain valve 210, and siphon breaker 212. FIG. 1C is a cross-sectional view of an existing, prior art embodiment of a washing machine showing the interrelation of inlet valves 202, drain outline 204, wash tub 206, drain valve 210, and siphon breaker 212. Wash tub 206 in existing washing machines 200 are generally circular and have a hollow region. Wash tubs 206 are generally oriented in a position to hold cloth items (e.g., linens, shirts, towels, washrags, socks, pants) while these cloth items are being washed, such as in a horizontal direction in commercial machines and vertical in residential machines. Wash tub 206 is generally rotated by an electrical motor 207 via belt 205. Electrical motor 207 is powered by power connection 211 and controlled via electrical circuitry 213 in an electrical panel. Cloth items are placed in wash tub 206 via an opening selectively closed by door 219. Water or a similar diluting liquid is injected into wash tub 206 via inlet valves 202. All liquid solutions, which may include a mixture of water and chemical solutions, and the dirt removed from the cloth items is removed via drain outlet 204, which is controlled by drain outlet valve 210 positioned in the pathway between the wash tub 206 and drain outlet 204. Examples of chemical solutions include sodium hydroxide, nonylphenol elhoxylate, complex phosphonate, sodium polyacrylate, sodium chloride, sodium hyphochlorite, quatemary, ammonium compounds, alkyl phosphates, phosphonic acid, distearyl dimenthyl and ammonium chloride. Drain outlet 204 is generally positioned on or near the lowest portion of wash tub 206, so that gravity aids with the draining of the chemical solutions and rinsing solutions from wash tub 206 when the washing and/or rinsing operations are complete. Cleaning materials or chemical solutions (e.g., detergents, bleach, etc.) are generally injected or poured into wash tub 206 via box 223 via channel 225, which is generally a rubber hose. Soap chemicals are placed in box 223 and then transferred into wash tub 206 in an undiluted state. Water is generally injected into wash tub 206 via inlet valve 202 with vent 201 and siphon breaker 212 at a top portion or upper portion of wash tub 206. Water is typically sprayed against cloth materials positioned in wash tub 206 and/or against the interior surfaces of wash tub 206. Vent 201 helps reduce the air pressure in the actual pathway between the inlet valve 202 and wash tub 206 in order to help the flow of water into wash tub 206. Siphon breaker 212 prevents the mixture of chemical solutions, water, and dirt held by wash tub 206 from being siphoned back out of inlet valves 202 when inlet valves are not transferring water or similar diluting solutions.

Note existing designs have a number of problems in that chemical solutions and water or diluting substances are actually injected into wash tub 206 separately and then mixed in wash tub 206 with cloth items already in place. As discussed above, chemical solutions, whether in an undiluted state or while being diluted, can burn or otherwise damage cloth items held by wash tub 206. Also note, chemical solutions can also damage rubber hose 225 and box 223 and then leak out into the interior region of washing machine 200, damaging everything it comes in contact with, such as the piping, electrical circuitry 213, electrical motor 207, belt 205, etc. It is easy to see how the damage to a washing machine can be compounded, as each mechanism begins to fail, other chemical solutions can also damage the interior surfaces of wash tub 206. Note alternate modifications have alternatively injected or sprayed chemical solutions into wash tub 206 via inlet valve 202 followed by a diluting solution, such as water, which still damages cloth items held by wash tub 206, because chemical solutions are not diluted. This approach also serves to damage the interior surfaces of wash tub 206 and, subsequently, the seals surrounding wash tub 206, the bearings used to rotate wash tub 206, etc.

FIGS. 1A, 1B, and 1C have the following dimensional information: distance 300 is 34⅜"; distance 301 is 18½"; distance 302 is 27¾"; distance 303 is 54"; distance 305 is 7½"; distance 307 is 48"; distance 308 is 18⁵⁄₁₆"; distance 309 is 38¾"; distance 310 is 2¾"; distance 311 is 7½"; distance 312 is 11"; distance 313 is 23"; distance 314" is 2¾"; and distance 315 is 1¼".

Figure 2B:
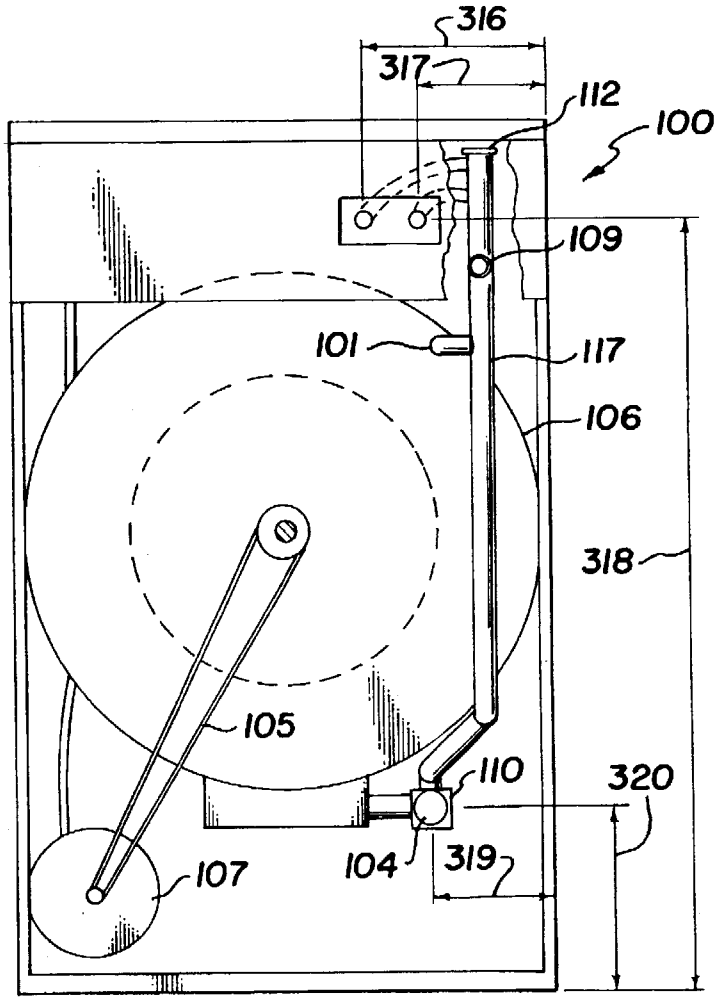
FIGS. 2A and 2B are front and back perspective illustrations of a preferred embodiment of washing machine 100 having inlet valves 102, drain outlet 104, wash tub 106, fill tube 117, door 119, drain valve 121, and siphon beaker 112 along with motor 107.
Figure 2A:
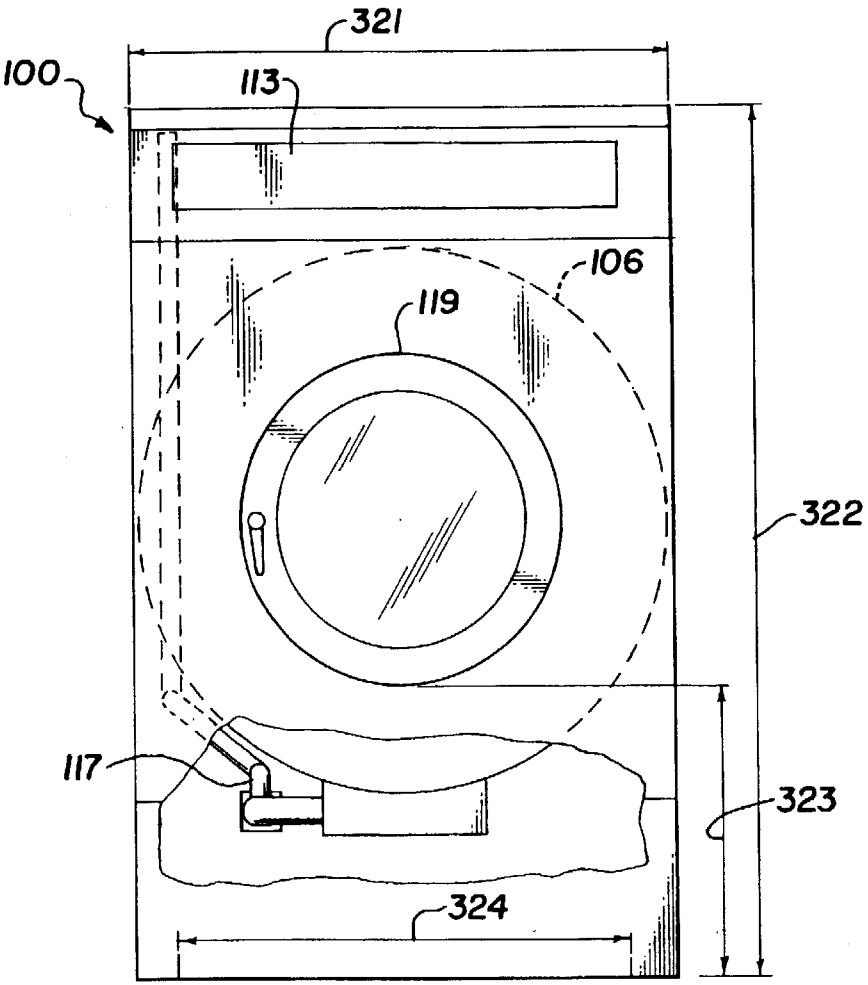
Figure 2C:
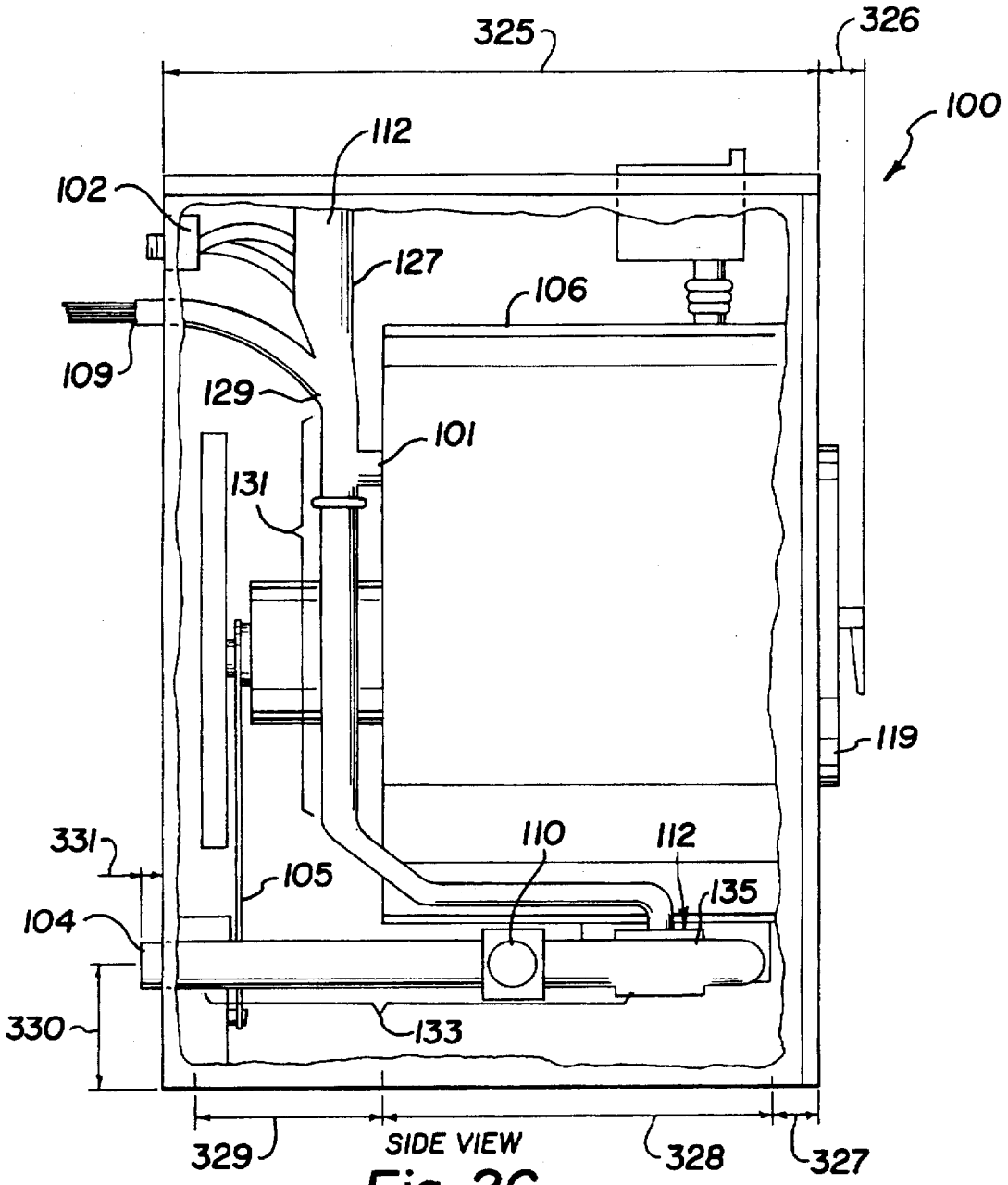
FIG. 2C is a cross-sectional view of a preferred embodiment of a washing machine 100 showing the interrelation of inlet valves 102, drain outlet 104, wash tub 106, chemical fill lines 109, drain valve 110, fill tube 117, and siphon breaker 112.

FIGS. 2A and 2B are front and back perspective illustrations of a preferred embodiment of washing machine 100 having inlet valves 102, drain outline 104, wash tub 106, fill tube 117, and siphon beaker 112 along with motor 110. FIG. 2C is a cross-sectional view of a preferred embodiment of a washing machine 100 showing the interrelation of inlet valves 102, drain outlet 104, wash tub 106, chemical fill lines 109, fill tube 117, drain valve 110, and siphon breaker 112. Wash tub 206 in preferred embodiments 100 are generally circular and have a hollow region. Wash tubs 106 are generally oriented in a position to hold cloth items (e.g., linens, shirts, towels, washrags, socks, pants) while these cloth items are being washed, such as in a horizontal direction in commercial machines and vertical in residential machines. Wash tub 106 is generally powered by an electrical motor 107 via belt 105. Electrical motor 107 is powered by power connection 111 and controlled via electrical circuitry 113 in an electrical panel. Cloth items are placed in wash tub 106 via an opening selectively closed by door 119. Chemical solutions used to clean cloth items are typically injected into wash tub 106 via siphon breaker 112. Water or a similar diluting liquid is injected into wash tub 106 via inlet valves 102. All liquid solutions, which may include a mixture of water and chemical solutions, and the dirt removed from the cloth items is removed via drain outlet 104, which is controlled by drain outlet valve 110 positioned in the pathway between the wash tub 106 and drain outlet 104. Drain outlet 104 is generally positioned on or near the lowest portion of wash tub 106, so that gravity aids with the draining of the chemical solutions and rinsing solutions from wash tub 106 when the washing and/or rinsing operations are completed. Chemical solutions (e.g., detergents, bleach, etc.) are generally injected into washing machine 100 via chemical lines 109, which intersect fill line 127 at junction 129. The water and chemical solutions are mixed inside mixing line 131 (e.g., pipe, conduit, passageway, or hose), which has a mixing line length and mixing line width, as mixing line 131 travels down the side of wash tub 106, where it joins drain outlet line 133. One high pressure 90 degree fitting can be used in lieu of the two 45 degree fittings shown in FIG. 2C. Note mixing line 131 joins drain outlet line between drain outlet valve 121 and wash tub drain 135 of wash tub 106, so that the drain outlet valve 110 can also be used to help fill up wash tub 106 and only one valve is needed. Note additional valves could be used, but may add cost and additional control concerns. Consequently, the mixture of chemical solutions and dilution liquids enter wash tub 106 via wash tub drain 135 already mixed together and fill wash tub 106 together from the bottom up. The actual time the chemical solutions exist in washing machine 100 in an undiluted state is small and insignificant, which minimizes the possibility of additional damage. Vent 101 helps reduce the air pressure in the mixing line 131, chemical line 109, and fill line 127. Siphon breaker 112 prevents the mixture of chemical solutions, water, and dirt held by wash tub 106 from being siphoned back out of inlet valves 102 and/or chemical line 109 when inlet valves are not transferring water or similar diluting solutions.

FIGS. 2A, 2B, and 2C has the following dimensional information: distance 316 is 11 13/16"; distance 317 is 8 5/6"; distance 318 is 48"; distance 319 is 7¼"; distance 320 is 7½"; distance 321 is 34⅜", distance 322 is 54"; distance 323 is 18½"; distance 324 is 27¾"; distance 325 is 38¾"; distance 326 is 2¾"; distance 327 is 2¾"; distance 328 is 23"; distance 329 is 11"; distance 330 is 7½"; and distance 331 is 1¼".

FURTHER MODIFICATIONS AND VARIATIONS

Although the invention has been described with reference to a specific embodiment, this description is not meant to be construed in a limiting sense. The example embodiments shown and described above are only exemplary. Various modifications of the disclosed embodiment as well as alternate embodiments of the invention will become apparent to persons skilled in the art upon reference to the description of the invention. For instance, the application of prediluted mixtures may also be presented from the side or, even from the top. The mixed, prediluted chemical solutions can be sprayed or poured in from the top or even by a center spigot. Similarly, the orientation of the wash tub in the washing machines may vary as well. Likewise, alternate materials can be used to adapt the equipment from residential to commercial washers. Schedule 40 PVC fittings and piping are generally used for mixing line 131, whereas Schedule 80 CPVC fittings and piping can be used for water temperature up to 200 degrees F., and Class K copper fittings and piping for water temperature 200 degrees and above. Neoprene or vitan flexible base can also be used with Schedule 40 PVC fittings. The above designs also extend to conversion kits, including Dexter™, and all other brands of commercial laundry equipment.

Thus, even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims. Accordingly, it should be understood that the modifications and variations suggested above and below are not intended to be exhaustive. These examples help show the scope of the inventive concepts, which are covered in the appended claims. The appended claims are intended to cover these modifications and alternate embodiments. In short, the restrictive description and drawings of the specific examples above are not intended to point out what an infringement of this patent would be, but are to provide at least one explanation of how to make and use the inventions contained herein. The limits of the inventions and the bounds of the patent protection are measured by and defined in the following claims.

What is claimed is:

1. An apparatus for prediluting at least one chemical solution before said at least one chemical solution is injected into a wash tub of a washing machine, said wash tub having an interior wash tub volume and a opening in communication with said interior wash tub volume, said washing machine having a housing to house said wash tub, comprising:

a) a chemical solution conduit to transport said at least one chemical solution into said wash tub of said washing machine, said chemical solution conduit having a first chemical opening therein to receive said at least one chemical solution;

b) at least one dilution conduit to transport a dilution solution into said washing machine, said at least one dilution conduit having at least one dilution opening therein to receive said dilution solution;

c) a mixing conduit having a first end and a second end, said second end in liquid communication with said opening in said wash tub of said washing machine to transport a mixed solution into said wash tub of said washing machine, wherein a substantial portion of said mixing conduit is positioned inside said housing of said washing machine; and d) a junction mechanically coupled to said at least one dilution conduit and to said chemical solution conduit, and to said first end of said mixing conduit, so that said at least one dilution conduit and said chemical solution conduit are in liquid communication with said interior wash tub volume of said wash tub, said junction combines and mixes said at least one chemical solution transported by said chemical solution conduit and said dilution solution transported by said at least one dilution conduit, so that said at least one chemical solution and said dilution solution are mixed together in said mixing conduit before entering said interior wash tub volume to form said mixed solution.

2. The apparatus of claim 1, further comprising a drain outlet in liquid communication with said opening in said wash tub of said washing machine through a drain outlet control valve and a drain conduit, said drain outlet control valve and said drain conduit mechanically joined together and mechanically positioned between said opening in said wash tub of said washing machine and said drain outlet to control said liquid communication between said opening in said wash tub of said washing machine and said drain outlet.

3. The apparatus of claim 2, wherein said mixing conduit is mechanically coupled to a portion of said drain conduit, wherein said portion of said drain conduit is positioned between said drain outlet control valve and said opening in said wash tub of said washing machine so that said mixing conduit and said drain conduit are in liquid communication with one another.

4. The apparatus of claim 1, wherein said mixing conduit has a mixing interior volume sufficiently large enough to permit adequate mixing of said at least one chemical solution and said dilution solution to create said mixed solution.

5. The apparatus of claim 4, wherein said mixing conduit is sufficiently long enough to enable said at least one chemical solution and said dilution solution to be adequately mixed together while said mixed solution is being transported to said interior wash tub volume of said wash tub of said washing machine.

6. The apparatus of claim 1, wherein said cloth items are selected from a group consisting of linens, shirts, towels, washrags, spreads, blankets, sheets, socks, pants, bed pads bed covers, supporting surgical linen and bed support nets.

7. The apparatus of claim 1, wherein said dilution solution is water.

8. The apparatus of claim 1, wherein said at least one chemical solution is selected from a group consisting of sodium hydroxide, nonylphenol elhoxylate, complex phosphonate, sodium polyacrylate, sodium chloride, sodium hyphochlorite, quaternary, ammonium compounds, alkyl phosphates, phosphonic acid, distearyl dimenthyl and ammonium chloride.

9. The apparatus of claim 1, wherein said at least one chemical solution is in liquid form.

10. A washing machine, comprising:

(a) a wash tub to hold cloth items, said wash tub having an interior wash tub surface forming an interior wash tub volume, said interior wash tub volume holding said cloth items, said wash tub also having a door coveting a portion of said interior wash tub volume to control access to said interior wash tub volume;

(b) said wash tub having an opening to transport a liquid mixture to into said interior wash tub volume;

(c) a dilution passageway to transport a dilution liquid into said interior wash tub volume via said opening of said wash tub;

(d) a chemical passageway to transport at least one liquid chemical solution into said interior wash tub volume via said opening of said wash tub, said chemical passageway mechanically coupled to said dilution passageway to form a mixture passageway; and (e) said mixture passageway mechanically coupled to said opening of said wash tub, so that said dilution passageway, said chemical passageway, said mixture passageway, and said interior wash tub volume of said wash tub are in liquid communication with one another and said at least one liquid chemical solution and said dilution liquid are adequately mixed together in said mixture passageway prior to entering said interior wash tub volume via said opening of said wash tub.

11. The washing machine of claim 10, further comprising a drain outlet mechanically coupled to said opening of said wash tub through a drain outlet control valve and a drain passageway, said drain outlet control valve mechanically joined to said drain passageway and positioned between said opening of said wash tub and said drain outlet to control liquid flow between said opening of said wash tub and said drain outlet.

12. The washing machine of claim 11, further wherein said mixture passageway is mechanically coupled to a first portion of said drain passageway between said drain outlet control valve and said opening of said wash tub, so that said mixture passageway is in liquid communication with said interior wash tub volume via said opening of said wash tub and said portion of said drain passageway.

13. The washing machine of claim 10, wherein said mixture passageway has a mixing interior volume sufficiently large enough to permit adequate mixing of said at least one liquid chemical solution and said dilution liquid.

14. The washing machine of claim 13, wherein said mixture passageway is sufficiently long enough and oriented to enable said at least one liquid chemical solution and said dilution liquid to be adequately mixed together while being transported to said wash tub.

15. The washing machine of claim 10, wherein said cloth items are selected from a group consisting of linens, shirts, towels, washrags, socks, and pants.

16. The washing machine of claim 10, wherein said dilution liquid is water.

17. The washing machine of claim 10, wherein said at least one chemical solution is selected from a group consisting of sodium hydroxide, nonylphenol elhoxylate, complex phosphonate, sodium polyacrylate, sodium chloride, sodium hyphochlorite, quaternary, ammonium compounds, alkyl phosphates, phosphonic acid, distearyl dimenthyl and ammonium chloride.

18. An apparatus for prediluting at least one chemical solution before said at least one chemical solution is injected into a wash tub of a washing machine, said wash tub having an interior wash tub volume and a wash tub opening in communication with said interior wash tub volume, comprising:

(a) a chemical solution conduit to transport said at least one chemical solution into said interior wash tub volume of said washing machine, said chemical solution conduit having at least one chemical opening therein to receive said at least one chemical solution and a second chemical opening;

(b) at least one dilution conduit to transport a dilution solution into said interior wash tub volume of said wash tub of said washing machine, said at least one dilution conduit having at least one dilution opening therein to receive said dilution solution and a second dilution opening;

(c) a mixing conduit having a first mixing opening and a second mixing opening, said second mixing in said liquid communication with said wash tub opening in said wash tub to transport a mixed liquid into said interior wash tub volume of said wash tub via said wash tub opening;

(d) a junction mechanically coupled to said second dilution opening of at least one dilution conduit and to said second chemical opening of said chemical solution conduit, and to said first mixing opening of said mixing conduit, so that said at least one dilution conduit and said chemical solution conduit are in liquid communication with said interior wash tub volume of said wash tub, said junction combines and mixes said at least one chemical solution transported by said chemical solution conduit and said dilution solution transported by said at least one dilution conduit, so that said at least one chemical solution and said dilution solution are mixed together in said mixing conduit before entering said interior wash tub volume of said wash tub via said wash tub opening; and (e) a drain outlet in liquid communication with said wash tub opening in said wash tub through a drain outlet control valve and a drain conduit, said drain outlet control valve and said drain conduit mechanically joined together and mechanically positioned between said wash tub opening in said wash tub and said drain outlet to control said liquid communication between said wash tub opening in said wash tub and said drain outlet.

19. The apparatus of claim 18, wherein said mixing conduit is mechanically coupled to a first portion of said drain conduit, so that said mixing conduit and said drain conduit are in liquid communication with one another.

20. The apparatus of claim 18, wherein said mixing conduit has a mixing interior volume sufficiently large enough to permit adequate mixing of said at least one chemical solution and said dilution solution.

21. The apparatus of claim 20, wherein said mixing conduit is sufficiently long enough to enable said at least one chemical solution and said dilution solution to be adequately mixed together while being transported to said interior wash tub volume of said wash tub.

22. The apparatus of claim 18, wherein said cloth items are selected from a group consisting of linens, shirts, towels, washrags, spreads, blankets, sheets, socks, pants, bed pads bed covers, supporting surgical linen and bed support nets.

23. The apparatus of claim 18, wherein said dilution solution is water.

24. The apparatus of claim 18, wherein said at least one chemical solution is selected from a group consisting of sodium hydroxide, nonylphenol elhoxylate, complex phosphonate, sodium polyacrylate, sodium chloride, sodium hyphochlorite, quaternary, ammonium compounds, alkyl phosphates, phosphonic acid, distearyl dimenthyl and ammonium chloride.

25. The apparatus of claim 18, wherein said at least one chemical solution is in liquid form.

26. A washing machine, comprising:

(a) a wash tub to hold cloth items, said wash tub having an interior wash tub surface forming an interior wash tub volume and a wash tub opening, said interior wash tub volume holding said cloth items, said wash tub also having a door covering a portion of said interior wash tub volume to control access to said interior wash tub volume;

(b) said wash tub having a wash tub opening to transport a liquid mixture into said interior wash tub volume;

(c) a dilution passageway to transport a dilution liquid into said interior wash tub volume via said wash tub opening;

(d) a chemical passageway to transport at least one chemical solution into said interior wash tub volume via said wash tub opening, said chemical passageway mechanically coupled to said dilution passageway to form a mixture passageway;

(e) said mixture passageway mechanically coupled to said wash tub opening of said wash tub, so that said dilution passageway, said chemical passageway, said mixture passageway, and said interior wash tub volume of said wash tub are in liquid communication with one another; and (f) a drain outlet mechanically coupled to said wash tub opening of said wash tub through a drain outlet control valve and a drain passageway, said drain outlet control valve mechanically joined to said drain passageway and positioned together between said wash tub opening of said wash tub and said drain outlet to control liquid flow between said wash tub opening of said wash tub and said drain outlet, further wherein said mixture passageway is mechanically coupled to said drain passageway between said drain outlet control valve and said wash tub opening, so that said mixture passageway is in liquid communication with interior wash tub volume via said wash tub opening of wash tub and a portion of said drain passageway.

27. The washing machines of claim 26, wherein said mixture passageway has a mixing interior volume sufficiently large enough to permit adequate mixing of said chemical solution and said dilution liquid.

28. The washing machine of claim 26, wherein said mixture passageway is sufficiently long enough and oriented to enable said at least one chemical solution and said dilution liquid to be adequately mixed together while being transported to said wash tub.

29. The washing machine of claim 26, wherein said cloth items are selected from a group consisting of linens, shirts, towels, washrags, socks, and pants.

30. The washing machine of claim 26, wherein said dilution material is water and said at least one chemical solution is selected from a group consisting of sodium hydroxide, nonylphenol elhoxylate, complex phosphonate, sodium polyacrylate, sodium chloride, sodium hyphochlorite, quaternary, ammonium compounds, alkyl phosphates, phosphonic acid, distearyl dimenthyl and ammonium chloride.

31. The apparatus of claim 1, wherein said opening in said wash tub is in a bottom portion of said wash tub and said wash tub is partially filled and drained through said opening of said wash tub.

32. The apparatus of claim 1, wherein said mixing conduit is adapted to be self-flushing.

33. The apparatus of claim 1, wherein said mixing conduit has an air vent mechanically coupled to said mixing conduit near said first end.

34. A washing machine, comprising:

(a) a wash tub to hold cloth items, said wash tub having an interior wash tub surface forming an interior wash tub volume and a wash tub opening, said interior wash tub volume holding said cloth items, said wash tub also having a door covering a portion of said interior wash tub volume to control access to said interior wash tub volume;

(b) said wash tub having a wash tub drain to transport a liquid mixture into and out of said interior wash tub volume;

(c) a dilution passageway;

(d) a chemical passageway mechanically coupled to said dilution passageway to form a mixture passageway;

(e) said mixture passageway mechanically coupled to a drain passageway, said drain passageway mechanically coupled to said wash tub drain of said wash tub, so that said dilution passageway, said chemical passageway, said mixture passageway, and said interior wash tub volume of said wash tub are in liquid communication with one another via said wash tub drain and said drain passageway, said chemical passageway to transport at least one liquid chemical solution into said interior wash tub volume via said chemical passageway, mixture passageway, drain passageway, and said wash tub drain, said dilution passageway to transport at least one dilution liquid into said interior wash tub volume via said chemical passageway, mixture passageway, drain passageway, and said wash tub drain; and (f) a drain outlet mechanically coupled to said wash tub drain of said wash tub through a drain outlet control valve and said drain passageway, said drain outlet control valve mechanically joined to said drain passageway and positioned together between said wash tub drain of said wash tub and said drain outlet to control liquid flow between said wash tub drain of said wash tub and said drain outlet, further wherein said mixture passageway is mechanically coupled to said drain passageway between said drain outlet control valve and said wash tub drain, so that said mixture passageway is in liquid communication with interior wash tub volume via said wash tub drain of wash tub and a portion of said drain passageway.

35. The washing machines of claim 34, wherein said mixture passageway has a mixing interior volume sufficiently large enough to permit adequate mixing of said chemical solution and said dilution liquid.

36. The washing machine of claim 34, wherein said dilution material is water and said at least one chemical solution is selected from a group consisting of sodium hydroxide, nonylphenol elhoxylate, complex phosphonate, sodium polyacrylate, sodium chloride, sodium hyphochlorite, quaternary, ammonium compounds, alkyl phosphates, phosphonic acid, distearyl dimenthyl and ammonium chloride.

* * * * *